United States Patent [19]

Ewald

[11] 4,243,161

[45] Jan. 6, 1981

[54] CONTINUOUS SPRAY BUTTON

[75] Inventor: Ronald F. Ewald, Rolling Meadows, Ill.

[73] Assignee: Seaquist Valve Co., Div. of Pittway Corp., Cary, Ill.

[21] Appl. No.: 872,236

[22] Filed: Mar. 17, 1978 (Under 37 CFR 1.47)

[51] Int. Cl.[2] ..... B65D 83/14

[52] U.S. Cl. ..... 222/402.14; 251/350

[58] Field of Search ..... 251/342, 350, 354; 222/153, 402.13, 402.14, 402.15, 402.21, 402.22, 402.23; 169/72

[56] References Cited

U.S. PATENT DOCUMENTS

| | | | |
|---|---|---|---|
| 2,703,665 | 3/1955 | Soffer et al. | 251/354 X |
| 3,123,260 | 3/1964 | Miles | 222/402.13 |
| 3,185,350 | 5/1965 | Abplanalp et al. | 222/402.11 |
| 3,225,966 | 12/1965 | Sagarin | 222/402.13 X |
| 3,901,412 | 8/1975 | Copia | 222/402.14 X |

FOREIGN PATENT DOCUMENTS

| | | | |
|---|---|---|---|
| 1306054 | 9/1962 | France | 222/402.13 |

*Primary Examiner*—David A. Scherbel
*Attorney, Agent, or Firm*—Stein & Frijouf

[57] ABSTRACT

A continuous spray button assembly of the type primarily used in conjunction with an aerosol dispenser and comprising a button contained within a tubular sleeve. The button and sleeve are rigidly press-fitted over the stem and turret of the valve, respectively. In one embodiment, two upstanding arms are disposed at the upper end of the sleeve. The button is pushed between the upstanding arms which lock the button into a tilted position thereby actuating the tilt valve and dispensing the product. By pushing the button in the reverse direction, the upstanding arms release the button located therebetween to deactuate the tilt valve and terminate dispensing of the product.

13 Claims, 15 Drawing Figures

FIG. 1
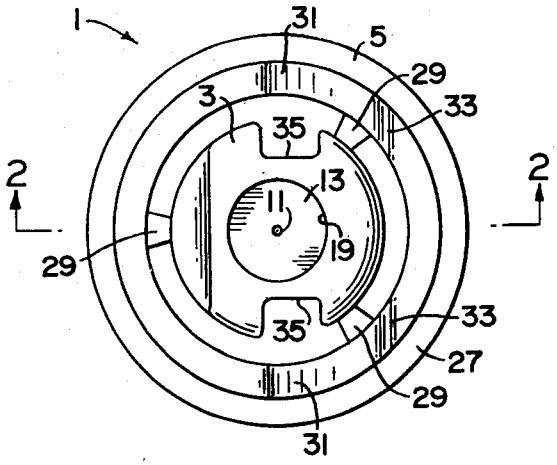
FIG. 4
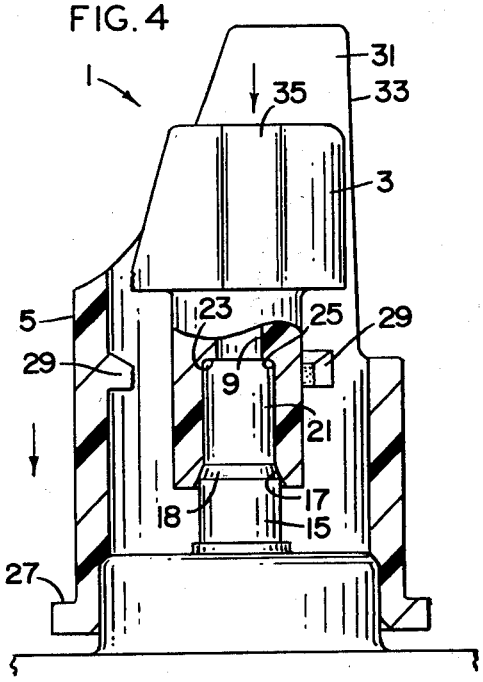
FIG. 2
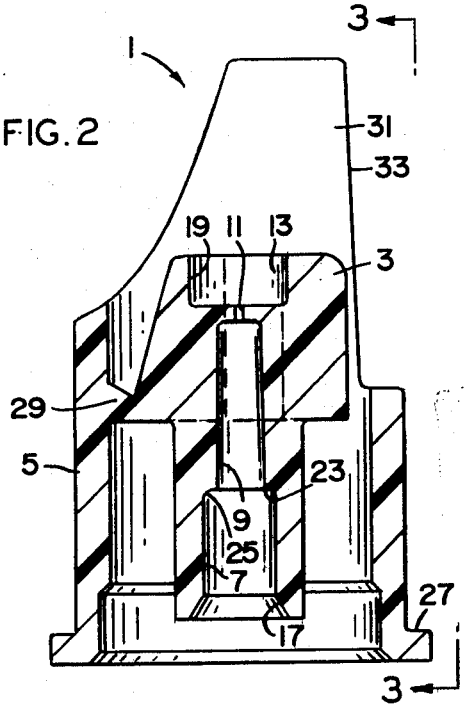
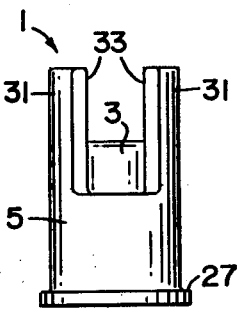
FIG. 3
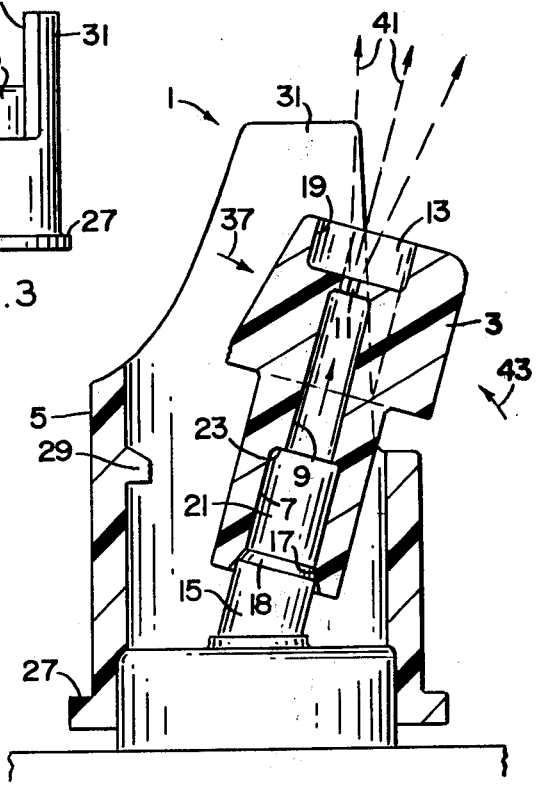
FIG. 5
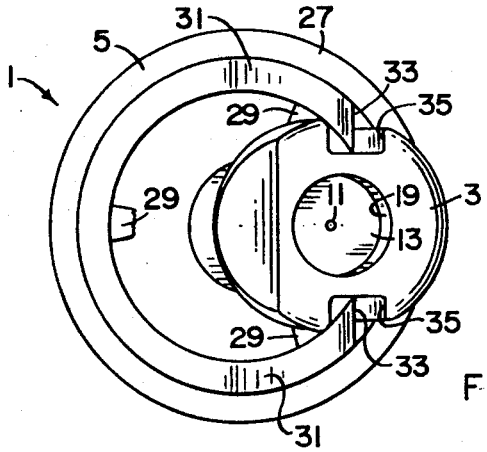
FIG. 6

CONTINUOUS SPRAY BUTTON

BACKGROUND OF THE INVENTION

1. Field of the Invention

This invention relates to a continuous spray button assembly of the type primarily used in conjunction with an aerosol dispenser. More particularly, this invention is a continuous spray button assembly comprising a button contained within a tubular sleeve. Movement of the button actuates the tilt valve thereby dispensing the product. This invention further comprises a cocking means which enables the button to be cocked into its "on" or "off" position at leisure.

2. Description of the Prior Art

Presently there exists many different types of spray button assemblies used in conjunction with an aerosol dispenser. When actuated, they are designed to establish fluid communication between the interior of the aerosol dispenser and the terminal orifice thereby dispensing the product. More particularly, there exists several types of spray valve button assemblies which are continuous. They are primarily designed to remain in their "on" position once they are actuated. Such is needed when it is desirous to dispense all of the product contained within the aerosol dispenser. In many other applications, it is desirous to dispense only a portion of the product. In this area, the prior art continuous spray valves are unsatisfactory since they cannot be turned off.

For example, one prior art continuous spray button assembly consists of an extra-long valve stem that has its end portion plugged or integrally blocked. Scored or crimped indentations are disposed below the blocked portion of the stem. To actuate, the stem is bent back and forth at the indentations which causes the stem to break off. An open passageway from the interior of the aerosol dispenser to the outside environment is thus formed. All of the product and propellant then escapes from the aerosol dispenser. A major disadvantage of this type of continuous spray button assembly is the inability to be turned "off" once the stem is broken off. Such can be particularly hazardous if the stem is accidentally broken off during shipment or storage. Another disadvantage is the ability to create a desired spray pattern. The product and propellant just haphazardly spews out of the stem. Thus, this type of continous spray valve is most undesirable.

Another type of continuous spray button assembly consists of a clip which actuates a tilt valve by holding the button in a downward "on" position. The clip is configured to be placed over the button and, when pressed down, clips onto the inside of the mounting cup. A hole within the center of the clip allows the product and propellant to be dispensed from the terminal orifice of the button. The clip cannot be easily dislodged from the mounting cup. Accordingly, the continuous spray button assembly cannot be easily turned off. A further disadvantage of this type is the two piece structure. The clip is usually loosely contained with the overcap of the aerosol dispenser for shipment and storage. It is therefore likely that the clip will be lost, especially when displayed and subjected to customer handling.

Another type of continuous spray button assembly consists of a button mounted upon a tilt type valve assembly and having an integral protruding arm. The protruding arm has a hooked portion at the outermost end. As the button is tilted into an "on" position, the hook portion of the protruding arm hooks over the edge of the mounting cup. An upstanding tab is integrally molded onto the protruding arm. When pressed, the tab unhooks the hook portion of the protruding arm thereby releasing the button. The button then returns to a normal vertical "off" position. A major disadvantage of this type of continuous spray button assembly is that the button requires both hands of the user to operate. One hand is required to hold the dispenser can and to push the button into a tilted position, and the other hand is required to help guide the hook portion of the protruding arm over the rim of the turret. Such is most inconvenient to the user of the aerosol dispenser. Another major disadvantage of this type of continuous spray button assembly is the inability to be permanently mounted with respect to the orientation of the dip tube. The orientation of the dip tube is such that the end of the dip tube is positioned within a specific edge portion of the bottom of the aerosol can. If the button is properly aligned with respect to the specific edge portion, the product may then be dispensed to the last drop. Since the stem may freely rotate within the tilt valve, the button along with the protruding arm mounted thereon is also able to freely rotate. Thus, the orientation of the button with respect to the dip tube is haphazard.

A major disadvantage of all of the prior art continuous spray button assemblies is the difficulty in being manufactured and assembled. They consist of irregular non-symmetrical shapes which are very difficult to manufacture by a molding operation. Furthermore the non-symmetrical configurations precludes the buttons from being automatically assembled with the rest of the aerosol dispenser. Hence, assembly workers must be hired to manually assemble the parts. Such is most uneconomical and thus undesirable.

Therefore, in order to overcome the inherent and particular inadequacies of the prior art, it is an object of this invention to provide a continuous spray button assembly which may be readily turned "on" and then "off".

Another object of this invention is to provide a structure which may incorporate many different types of valve buttons to achieve the desired spray pattern.

Another object of this invention is to provide a structure that may be molded as a singular piece.

Another object of this invention is to provide a means for permanently locating the button with respect to the orientation of the dip tube.

Another object of this invention is to provide a structure which requires only one hand to operate.

Another object of this invention is to provide a structure that can be automatically assembled with the tilt valve assembly.

Another object of this invention is to provide a means for the button to be used in conjunction with a "male" or "female" type of a tilt valve assembly.

Another object of this invention is to provide a protective means to prevent accidental actuation of the button.

Other objects and a fuller understanding of this invention may be had by referring to the summary of the invention, the desciption and the claims, taken in conjunction with the accompanying drawings.

SUMMARY OF THE INVENTION

The subject invention relates to a continuous spray button assembly of the type primarily used with aerosol dispensers. Conventional aerosol dispensers operate by dispensing a propellant and product contained within the pressurized can of the dispenser itself. The propellant and product is normally dispensed when the valve assembly is actuated by the movement of the valve button. The desired spray pattern is created by the combination and disposition of swirl chambers, expansion chambers, and the terminal orifices. More particularly, this invention is designed for use in conjunction with a tilt type valve assembly. In a tilt type valve assembly, fluid communication between the interior of the dispenser can and the valve button is achieved by tilting the valve stem. Typical tilt valve assemblies are shown in U.S. Pat. Nos. 2,767,023, 3,088,682, 3,155,290, 3,506,241, 3,545,720, 3,547,405, and 3,658,294.

The continuous spray button assembly of the subject invention comprises a valve button loosely contained within a tubular sleeve. The sleeve and the button are rigidly press-fitted onto the turret and the stem, respectively, of the tilt valve assembly. A retaining mechanism is incorporated into the subject invention to retain the button into a tilted "on" position for dispensing the product. To terminate the dispensing of the product, the button is uncocked and is returned to the original vertical "off" position.

The retaining means may be a finger, step, ridge, arm, protrusion, or the like which resiliently retains the valve button into an "on" position. In the first embodiment of this invention, the retaining mechanism includes two extending arms integrally disposed at the top of the tubular sleeve. In operation, the button is tilted between the two extending or upstanding arms which grasp the button located therebetween. Thus, the button is held in an "on" position. The resilient nature of the upstanding arms allows the button to be easily released by simply pushing on the button in a reverse direction. To more securely lock the button in the tilted position, an indentation may be made on each side of the button. When the button is pushed between the upstanding arms, the edges of the upstanding arms correspondingly fit into the indentations thereby grasping the button more securely. Again, the button is easily released by simply pushing the button in the reverse direction.

Another embodiment of the retaining means includes a single upstanding arm integrally disposed at the end of the tubular sleeve. This embodiment is quite similar to the first embodiment. As the valve button is tilted, the side of the upstanding arm fits into an indentation on the side of the button thereby retaining the button into the "on" position. The cooperation of the arm and the indentation causes the button and the stem to rotate within the turret of the tilt valve assembly. To prevent such rotation, an elongated step may be integrally disposed on the inside of the sleeve in an axial direction. A corresponding rectangular step is integrally incorporated onto the button. The two rectangular steps are thus disposed in a side by side relationship to prevent rotation of the button and stem. Upon tilting the button, the rectangular step of the button is moved from a side by side relationship to an angled position. The bottommost corner of the rectangular step of the button thus pivots against the side of the rectangular step of the sleeve thereby preventing rotation.

Another type of cocking means may comprise a protrusion disposed upon the interior of the tubular sleeve to cooperate with another protrusion disposed on the valve button. Upon tilting the button, the protrusion of the button overrides the protrusion of the sleeve to be seated thereby. Thus, the button is cocked into an "on" position. To uncock the button, the button is pushed in the reverse direction which causes the protrusion of the button to slip off the protrusion of the sleeve. The button then returns to normal vertical "off" position. Alternatively, a single protrusion may exist upon the inner wall of the sleeve which cooperates with a bottommost flanged edge of the button. Similarly, when tilted, the bottommost edge of the button overrides the protrusion of the sleeve and is seated thereon. To release the button, the button is simply pushed in the reverse direction, unseated, and then returns to the "off" position.

Another type of retaining means may comprises a finger which is integrally disposed on the side of the valve button. As the button is tilted, the finger resiliently snaps into an indentation disposed on the inner wall of the tubular sleeve. Such locks the button in the "on" position, thereby dispensing the product. Movement into the vertical "off" position is accomplished by simply pushing the button in the reverse direction thereby causing the finger to slide out of the indentation and releasing the button.

A major feature of this invention is the ability to be turned "on" or "off" at leisure. In many applications this feature is most desirable. For instance, when a large portion of the product must be dispensed, it is desirable to utilize a continuous spray button assembly so that the user of the aerosol dispenser will not be fatigued by having to continually press the valve button. Such is true with many types of applications such as bug defoggers, household deodorants, paint sprayers, or rug cleaners. It is noted that this continuous spray button assembly may be operated in a manner similar to most of the prior art devices. The entire product may be dispensed as called for in some applications such as, for example, a bug fumigator.

Another feature of this invention is the ability to incorporate almost any type of button or terminal orifice into the structure. The desired spray pattern is a function of the swirl chambers, expansion chambers, and the configuration of the terminal orifice, and is dependent on the type of product being dispensed. Thus, it is most desirous to be able to use many different types of valve buttons depending on the product being dispensed. It is noted that whatever type button is utilized, the retaining means can still be integrally molded within the tubular sleeve, thereby maintaining a one piece configuration. It is also noted that inserts such as a mechanical breakup (MBU) button insert may be incorporated in the button if it is desirous to mechanically atomize the product before dispensing.

Another feature of this invention is the unique simplicity. Contrary to the prior art continuous spray button assemblies, this spray valve is molded as a single piece. During the molding operation, plastic material fills the mold of the sleeve and then fills the mold for the button via connecting channels. Hence, after molding, the material which filled the channels forms connecting fins disposed between the sleeve and button. Thus, the sleeve and button are actually a single molded piece.

To assemble the continuous spray button assembly onto the aerosol dispenser, the button is first inserted onto the valve stem. Further downward motion then severs the connecting fins which allows the sleeve to be moved further downward to be seated around the turret. Thus, only a single downward motion is required in order to assemble the continuous spray button assembly onto the aerosol dispenser. Hence, the assembly operation can be fully automated.

Another feature of the continuous spray button assembly is the ability to be assembled onto the aerosol dispenser in a relation respective to the orientation of the dip tube. The end of the dip tube is usually oriented in a specific bottommost edge portion of the interior of the aerosol can. By tilting the aerosol can such that all of the product contained therein flows to that specific edge portion, the last drop of the product may be dispensed. Thus, the terminal orifice must be permanently oriented to correspond to the orientation of the dip tube. This is accomplished by rigidly attaching the sleeve to the turret. The sleeve therefore cannot rotate and thus the terminal orifice is always pointed in the correct direction.

Another feature of this invention is the ability to be also applicable to a valve button having what may be termed a "male" configuration. More specifically, instead of providing a button with a stem recess, the continuous spray button assembly could incorporate a button wherein the stem is integrally attached to the button. In this embodiment, the button does not include the stem recess per se since the stem is integrally attached thereto.

Another feature of this invention is the inherent provision to prevent accidental actuation of the tilt valve assembly. The tubular sleeve protects the valve button enclosed therein, thereby protecting the button from being accidentally tilted. Accordingly, such prevents accidental actuation of the tilt valve assembly. Even more so, in the preferred embodiment of this invention, the upstanding or extending arms, which are disposed at the top of the sleeve, provide an even more protective means to prevent such an accidental actuation.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top view of a continuous spray button assembly of the invention;

FIG. 2 is a cross-sectional view along lines 2—2 of FIG. 1, prior to assembly on a turret of a tilt valve;

FIG. 3 is a front view along line 3—3 of the tubular sleeve of the continuous spray button assembly shown in FIG. 2;

FIG. 4 is a cross-sectional view of the continuous spray button assembly positioned on a valve stem and valve turret;

FIG. 5 is a cross-sectional view of the continuous spray button assembly shown tilted in an actuated position;

FIG. 6 is a top view of FIG. 5;

Similar reference characters refer to similar parts throughout the several view of the drawing.

DESCRIPTION OF THE PREFERRED EMBODIMENT

Figure 7:
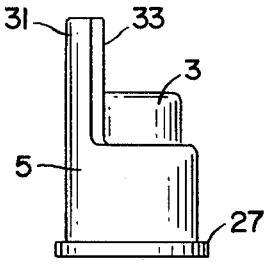
FIG. 7 is a front view similar to FIG. 3 showing a single upstanding arm of the second embodiment of the invention.

As generally shown in FIGS. 1, 2 and 3, this invention is a continuous spray button assembly which comprises a valve button 3 contained within a tubular sleeve 5. A retaining or cocking means is incorporated in the button assembly 1 to retain or cock the button 3 into a tilted position. The tilted button 3 actuates a tilt valve assembly (not shown) thereby causing the product and propellant to be dispensed.

The button 3 is particularly shown as including a stem recess 7, expansion chamber 9, terminal orifice passage 11 and recessed face 13 to provide fluid communication between the tilt valve assembly of the aerosol container (not shown) and the outside air. The stem recess 7 is configured and dimensioned to be rigidly press-fitted onto the valve stem 15 of the tilt valve assembly (see FIG. 4). The stem is further configured to have an inner annular chamfered edge 17 which is designed to seat upon a corresponding annular angled step portion 18 of the valve stem 15.

The button 3 is also applicable to a "male" configuration (not shown) such as an integral valve stem. The integral valve stem would be insertable into a recess of the tilt valve assembly. Thus, tilting of the button 3 would actuate the tilt valve assembly via the integral valve stem.

The expansion chamber 9 is integrally formed on the interior of the button 3 and disposed in direct fluid communication with the terminal orifice passage 11 and the stem recess 7. The expansion chamber is particularly disposed and configured to allow the "flash" of the product as the product issues from the valve stem 15. This enlarged configuration allows for the rapid evaporation of the propellant prior to being dispensed through the terminal orifice passage 11.

The terminal orifice passage 11 defines an exclusive fluid communication path between the expansion chamber 9 and the terminal orifice. The passage 11 comprises a linear portion of a substantially consistent diameter along the entire length thereby giving a linear versus a tapered configuration. It is noted that other configurations of the terminal orifice passage may be utilized for adequate spray pattern control in realizing the desired or predetermined spray pattern, dependent upon the product being dispensed.

The recessed face 13 is defined by a substantially rectangular cross-sectional cavity. The depth of the recessed face 13 must be shallow enough to avoid product impingement upon the wall 19 of the recessed face 13 or the exterior of the button 3. The cavity may be configured to receive an insert such as a mechanical breakup (MBU) button insert.

The tubular sleeve 5 has a substantially cylindrical configuration which is dimensioned to be press-fitted over the valve turret 21. More particularly, the button sleeve 5 has an inner annular seat portion 23 which seats upon the turret 21. The leading edge 25 of the seat portion 23 is chamfered to help locate the sleeve 5 about the turret during affixation. Furthermore, the lowermost portion of the sleeve 5 has an outer annular step 27. During affixation, the assembly tool grasps the sleeve 5 and pushes downwardly against the annular step 27 to press-fit the seat portion 23 over the turret 21. This process may be accomplished by a machine process without the use of an assembly worker.

The continuous spray button assembly 1 can be molded as a singular piece. A liquid molding material, such as a plastic, is injected into the mold of the button assembly 1. The liquid fills the cavity for the sleeve 5 then fills the cavity for the button 3 via connecting channels disposed therebetween. Thus, after molding, the button assembly 1 consists of the button 3 integrally molded into the sleeve 5 by connecting fins 29 which were formed from the connecting channels. Hence, the entire button assembly 1 is a single molded piece.

As best shown in FIG. 4, the singular piece is mounted onto the tilt valve assembly in a single downward motion of the assembly machine. First, the stem recess 7 of the button 3 is downwardly press-fitted over the valve stem 15 and is seated upon its inner chamfered edge 17. Further downward motion severs the connecting fins 29 as the seat portion 23 of the sleeve 5 is press-fitted around the valve turret 21.

As best shown in FIG. 3, the first embodiment of the retaining means comprises two upstanding or extending arms 31 which are integrally disposed at the upper end of the sleeve 5. The arms have an arcuate configuration which further defines the cylindrical configuration of the sleeve 5 (see FIG. 1.) Upon tilting the buttom 3, the edge portion 33 of the upstanding arms 31 resiliently fits into corresponding indentations 35 disposed on the side of the button 3. This locks the button 3 into a cocked "on" position thereby actuating the tilt valve assembly and thus dispensing the product.

In operation, the user of the aerosol dispenser pushes the valve button 3 in the direction of arrow 37. The upstanding arms 31 resiliently flex apart thereby allowing the button 3 to be pushed therebetween. After the button 3 is tilted to a predetermined angle, an edge portion 33 of the upstanding arms 31 fit into a corresponding indentation 35 disposed on the side of the button 3. This locks the button 3 into a tilted "on" position (see FIGS. 5 and 6). The valve stem 15 contained within the stem recess 7 of the valve button 3 is also tilted to actuate the tilt valve assembly. Fluid communication is thus established and the product and propellant is dispensed in the direction of arrow 41.

To terminate the continuous dispensing of the product, all the user must do is push the button 3 in the direction of arrow 43. This causes the upstanding arms 31 to flex apart thereby releasing the button 3. The button 3 then returns to the natural vertical "off" position. Thus, the tilt valve assembly is deactuated and the dispensing of the product terminates. Accordingly, it is clearly seen that this invention allows the user to dispense any portion or all of the product at leisure.

Figure 8:
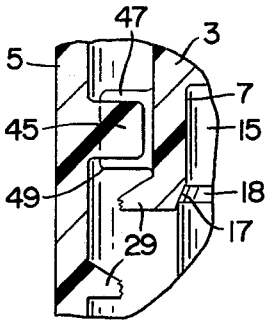
FIG. 8 is a partial view of the second embodiment of the invention showing retaining means including a rectangular step of the button and a rectangular step of the sleeve's in a side-by-side relationship.
Figure 9:
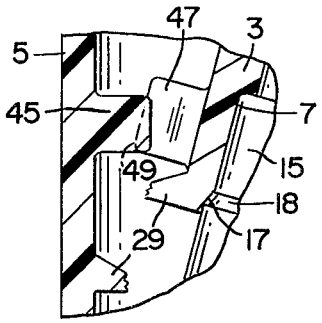
FIG. 9 is another partial view of the second embodiment of the retaining means showing the rectangular steps in a tilted side-by-side relationship.

Other embodiments of the retaining means may be incorporated into the invention which operate in a manner similar to the first embodiment disclosed above. In particular, a second embodiment of the retaining means comprises a single upstanding arm 31 disposed at the end of the tubular sleeve 5 (see FIG. 7). The edge portion 33 retains the button 3 into a tilted "on" position by fitting into a corresponding indentation 35 disposed on the side of the button 3. It is noted that the button 3 may have a tendency to rotate when tilted. A rectangular step 45 may be disposed on the inside of the sleeve 5, and another rectangular step 47 may be disposed on the outside of the button 3. The two steps 45,47 are positioned in a side-by-side relationship (see FIGS. 8 and 9), thereby preventing rotation of the button 3. More particularly, upon tilting of the button 3, the lowermost edge portion 49 step of the button 47 pivots against the step of the sleeve 45 to prevent rotation of the button 3 when tilted.

Figure 10:
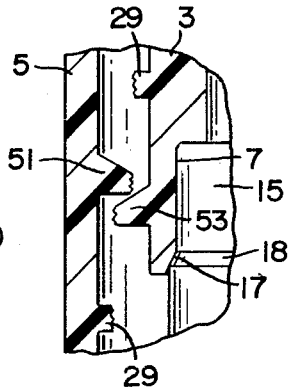
FIG. 10 is a partial view of a third embodiment of the retaining means showing protrusions disposed on the sleeve and the button.
Figure 11:
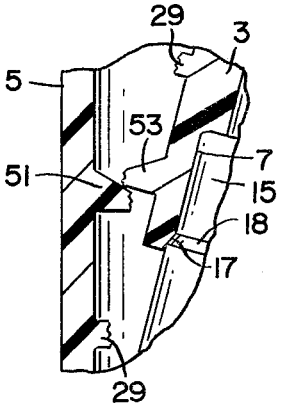
FIG. 11 is a partial view of the third embodiment of the retaining means in a cocked position.

A third embodiment of the retaining means comprises a protrusion 51 disposed on the inside of the sleeve 5 that cooperates with another protrusion 53 disposed on the outside of the button 3 (see FIG. 10). Upon tilting the button 3, the protrusion of the button 53 resiliently overrides and is seated on top of the protrusion 51 of the sleeve thereby cocking or retaining the button 3 into a "on" position (see FIG. 11). To uncock the button 3, the button is simply pushed in the reverse direction, which causes the protrusion 53 of the button to slip off of the protrusion 51 of the sleeve. Hence, the button 3 returns to the vertical "off" position.

Figure 12:
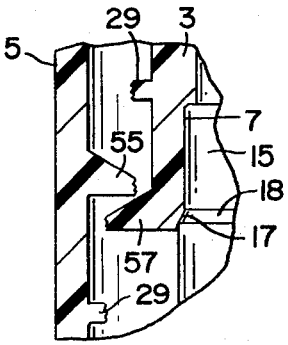
FIG. 12 is a partial view of a fourth embodiment of the retaining means showing a protrusion of a sleeve and the flared edge of the button.
Figure 13:
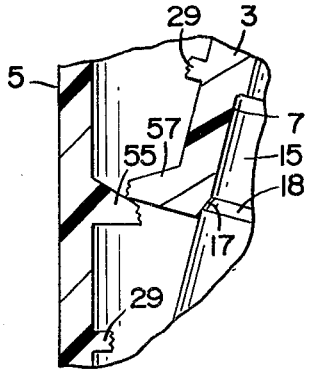
FIG. 13 is a partial view of the fourth embodiment of the retaining means in a cocked position.

Similarly, a fourth embodiment of the retaining means comprises a protrusion 55 of the sleeve cooperating with a lowermost flanged edge 57 of the button 3 (see FIG. 12). The flanged edge 57 overrides the protrusion 55 of the sleeve and to seat on top of the protrusion 55 as the button 3 is tilted into the "on" position, thereby dispensing the product and propellant (see FIG. 13). The button 3 may be uncocked by simply pushing the button 3 in a reverse direction thus causing the flanged edge 57 to slip off of the protrusion 55 of the sleeve.

Figure 14:
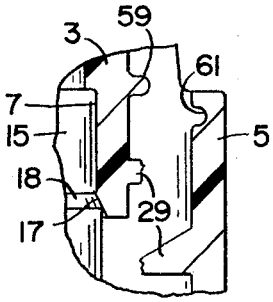
FIG. 14 is a partial view of a fifth embodiment of the retaining means showing a protrusion of the button and the indentation in the wall of the sleeve.
Figure 15:
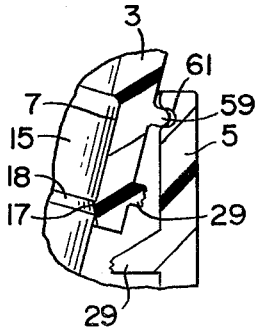
FIG. 15 is a partial view of the fifth embodiment of the retaining means in a cocked position.

A fifth embodiment of the retaining means comprises a finger 59 which is integrally disposed on the side of the valve button 3 (see FIG. 14). As the button is tilted, the finger 59 resiliently snaps into an indentation 61 disposed on the inner wall of the sleeve 5 (see FIG. 15). Such cocks the button 3 into the "on" position thereby dispensing the product and propellant. As the button 3 is tilted back into the "off" position, the finger 59 slips out of the indentation 61, thereby uncocking the button 3.

It is noted that in all of the embodiments of the retaining means, connecting fins 29 may still be disposed between the button 3 and the sleeve 5. Hence, as disclosed above, the continuous spray button assembly 1 may always be molded as a singular piece.

The present disclosure includes that contained in the appended claims, as well as that of the foregoing description. Although this invention has been described in its preferred form with a certain degree of particularity, it is understood that the present disclosure of the preferred form has been made only by way of example and the numerous changes in the details of construction and the combination and arrangement of parts may be resorted to without departing from the spirit and scope of the invention.

Now that the invention has been described:

1. A continuous spray button assembly for use with a tilt valve having a valve turret, comprising in combination:

a tubular sleeve;

a valve button;

said tubular sleeve configured and dimensioned to be rigidly attached to the valve turret of the tilt valve;

said tubular sleeve extending from the valve turret of the tilt valve to at least partially encircle the outer perimeter of said valve button;

said valve button configured to actuate the tilt valve when moved into a tilted position;

a retaining means including a latch coacting between said valve button and said tubular sleeve to retain said valve button in said tilted position upon actuation of the tilt valve for enabling continuous spray; and said latch configured to release the tilt valve from the tilted position to the non-tilted position upon relative movement between said valve button and said tubular sleeve for interrupting the continuous spray.

2. The continuous spray button assembly as set forth in claim 1 wherein said tubular sleeve further comprises a step portion disposed annularly about the outer lowermost end portion of said tubular sleeve.

3. The continuous spray button assembly as set forth in claim 1 wherein said tubular sleeve further comprises a seat portion disposed annularly about an inner lowermost end portion to be rigidly press-fitted around said valve turret of said tilt valve.

4. The continuous spray button assembly as set forth in claim 1 wherein said valve button comprises a stem recess configured and dimensioned to be press-fitted over the valve stem of said tilt valve.

5. The continuous spray button assembly as set forth in claim 1 wherein said valve button comprises an integral valve stem which is configured to be inserted into said tilt valve whereby said tilt valve is actuated by the movement of said valve button.

6. A continuous spray button assembly for use with a tilt valve comprising in combination:

a tubular sleeve;

a valve button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray; and said retaining means comprising two extending arms disposed at the upper end of said tubular sleeve whereby said valve button may be pushed therebetween and held in said tilted position.

7. The continuous spray button assembly as set forth in claim 6 wherein an identation is disposed on each side of said valve button whereby an edge portion of said upstanding arms fit into said identations when said valve button is pushed therebetween.

8. A continuous spray button assembly for use with a tilt valve comprising in combination:

a tubular sleeve;

a valve button having an identation on a side of said button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray; and said retaining means including an extending arm disposed at the upper end of said tubular sleeve for engagement with said indentation on said side of said valve button.

9. A continuous spray button assembly for use with a tilt valve comprising in combination:

a tubular sleeve;

a valve button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray;

said retaining means further comprising a first substantially rectangular step disposed on the inside portion of said tubular sleeve; and a second substantially rectangular step disposed on said valve button for cooperation with said first step for preventing rotation of said valve button within said tubular sleeve.

10. A continuous spray button assembly for use with a tilt valve comprising in combination:

a tubular sleeve;

a valve button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray; and said retaining means comprising a first protrusion disposed on the inside portion of said tubular sleeve for cooperation with a second protrusion disposed on said valve button upon said valve button being disposed in said tilted position.

11. A continuous spray button assembly for use with a tilt valve comprising in combination:

a tubular sleeve;

a valve button having a flanged portion extending from said valve button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray; and said retaining means comprising a protrusion disposed on the inside portion of said tubular sleeve for cooperation with said flanged portion extending from said valve button upon said valve button being moved into said tilted position.

12. A continuous spray button assembly for use with a tilt valve comprising in combination:

a tubular sleeve having an identation disposed on an inner wall of said sleeve;

a valve button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray; and said retaining means comprises a finger disposed on said valve button for engagement with said indentation disposed on said inner wall of said tubular sleeve upon movement into said tilted position.

13. A continuous spray button assembly for use with a tilt valve comprising in combination:

a tubular sleeve;

a valve button;

said tubular sleeve configured and dimensioned to be rigidly attached relative to the tilt valve;

said valve button configured to actuate the tilt valve when moved into a tilted position;

a retaining means configured to retain said valve button in said tilted position upon actuation of said tilt valve for enabling continuous spray; and at least one connecting fin integrally disposed between said valve button and said tubular sleeve thereby forming a one piece structure.

* * * * *